United States Patent [19]

Forsyth

[11] 4,270,482

[45] Jun. 2, 1981

[54] DROP MARKER

[75] Inventor: Robert J. Forsyth, College Place, Wash.

[73] Assignee: North American Industries, Inc., Walla Walla, Wash.

[21] Appl. No.: 868,886

[22] Filed: Jan. 12, 1978

[51] Int. Cl.[2] ..... G09F 9/00

[52] U.S. Cl. ..... 116/209

[58] Field of Search ..... 116/124 B, 124 R, 209; 340/24, 25; 150/39

[56] References Cited

U.S. PATENT DOCUMENTS

| | | | |
|---|---|---|---|
| 2,744,557 | 5/1956 | Link | 150/39 |
| 3,428,019 | 2/1969 | Tillay | 116/124 B |
| 3,470,846 | 10/1969 | Tillay | 116/124 R |
| 3,973,513 | 8/1976 | Howe | 116/124 B |

*Primary Examiner*—S. Clement Swisher
*Assistant Examiner*—Denis E. Corr
*Attorney, Agent, or Firm*—Wells, St. John & Roberts

[57] ABSTRACT

A marker, designed to be dropped from an airplane to indicate its flight path along a ground area, includes an elongated streamer having first and second base members fixed to its respective ends. The streamer has transverse pleats folded accordian-style, which allow it to be folded to a first condition for storage between the base members and to open to a second condition where the streamer is extended longitudinally with the base members fixed to the respective ends of it. When unfolded in the air after being discharged from an aircraft, the base members pull the two ends of the streamer downward in an arch, which is then capable of draping over high field crops or trees.

10 Claims, 7 Drawing Figures

DROP MARKER

This invention relates to a drop marker used in marking areas traversed by an aircraft or other vehicle. It is particularly adapted for use in marking areas to which chemicals have been applied from moving aircraft.

BACKGROUND OF THE INVENTION

Tillay et al U.S. Pat. No. 3,428,019 shows a drop marker currently in use which includes a trapezoidal base member and a streamer strip of flexible material folded to and fro in a flat condition against the base member prior to ejection from an aircraft, as by use of the dispenser of Tillay et al U.S. Pat. No. 3,470,826. Upon ejection, the streamer is initially pulled by the relative air velocity over the base, but the weight of the base member causes it to move downwardly ahead of the streamer. When the base member reaches the ground, in crops of relatively low height, the streamer tends to float downwind to produce an elongated, normally visible strip. While very effective for marking fields having crops of relatively low height, these drop markers, weighted at one end, are not as effective in marking taller crops, such as corn, hops, pole beans or cotton, nor are they as effective in marking orchards or forests. The heavy base member tends to fall through the crop or trees, pulling the flexible streamer down with it. This has resulted in the use of longer streamers, often highly colored, as of fluorescent red, in an attempt to maintain visibility of the streamer on the ground or in the crop area, but without satisfactory results.

SUMMARY OF THE INVENTION

The present drop marker has a folded streamer with two base members, one being attached to each of its longitudinal ends. The weight per unit area of each base member exceeds that of the streamer, causing the ends of the streamers to fall ahead of its central area. Thus, the streamer attains an inverted U-shaped pattern or arch which drapes over the crop or trees and remains visible from the air. Best results have been obtained when the weight of the second, normally smaller, base member exceeds one-half the weight of the larger, first base member. The difference in size of the first and second base members facilitates ejection of the marker from the aircraft.

DESCRIPTION OF THE PREFERRED EMBODIMENT

Figure 1:
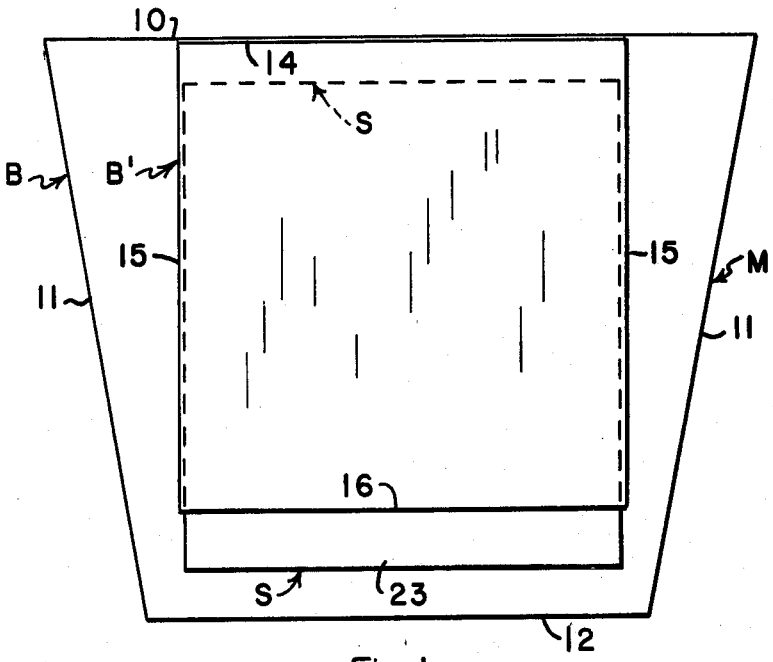
FIG. 1 is a rear elevation of a drop marker of this invention.
Figure 2:
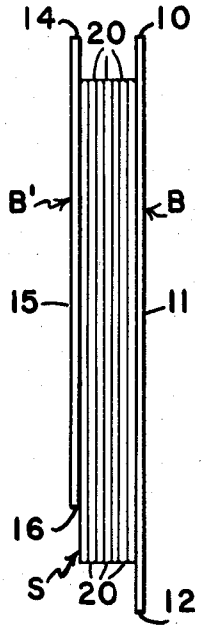
FIG. 2 is a side elevation of the marker.
Figure 3:
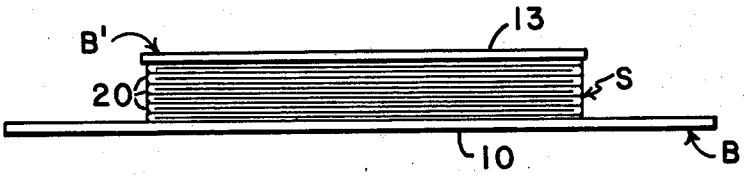
FIG. 3 is a top plan view of the marker, in a position reverse to that of FIG. 1.
Figure 5:
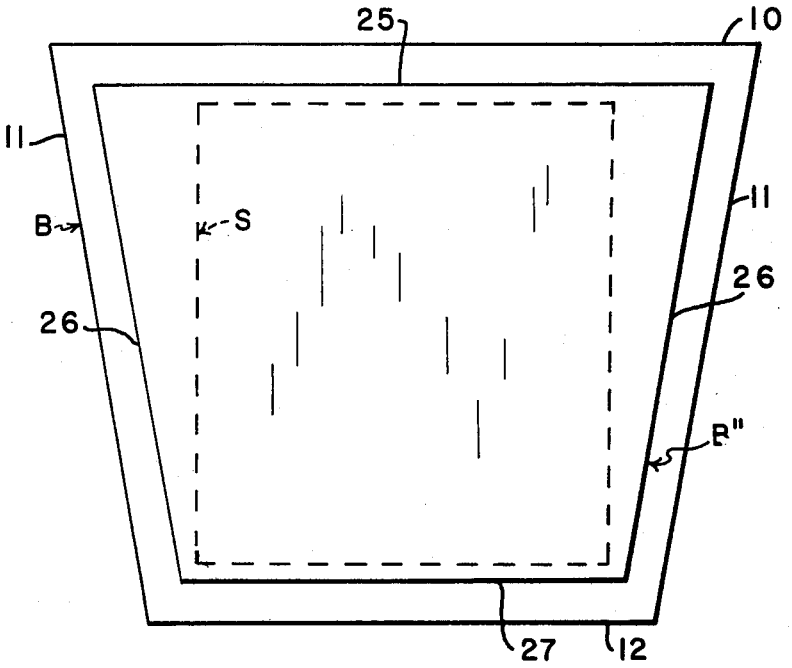
FIG. 5 is a rear elevation, similar to FIG. 1, of an alternative marker of this invention.

A drop marker M of FIGS. 1–3 comprises two base members B and B′ and an intermediate streamer S. The base member B has a trapezoid form, thus having a longer top edge 10, downwardly and inwardly inclined sides 11 and a bottom edge 12 parallel to the top edge, while the base member B′, as shown, is square or rectangular in shape and having a top edge 14, side edges 15 perpendicular to the top edge and a bottom edge 16 parallel to the top edge. The trapezoid form of base B coincides with the requirements of an existing aircraft dispenser disclosed in aforesaid U.S. Pat. No. 3,470,846, to which reference is made for details of construction not shown in the general illustration of the ejector E in FIG. 7. It will be understood that the particular shapes of bases B and B′, as well as base B″ of FIG. 5, are presented only by way of illustration and are not intended to limit the present disclosure, since either or both bases may be oval, round elliptical or have other peripheral shapes.

Each base member B and B′ is constructed of relatively stiff sheet material. Since it is desirable that the drop marker be degradable on the ground after its usage, the drop marker components are preferably constructed of cellulosic materials. Cardboard, often referred to as pasted chip board, fiber board, molded pulp, corrugated board and other degradable sheet materials are best suited for this purpose. Other types of sheet material, such as plastics or metal and which can be stiff or flexible, could be used. The base members are shown as having uninterrupted surface areas, but it is to be understood that they might be apertured or vented if necessary to assure spreading of streamer S when used with a particular dispenser.

The streamer S is elongated and has substantial length compared to the dimensions of the base members B and B′. It is preferably constructed of flexible sheet material, such as tissue paper, but could be constructed of material having more stiffness, but capable of being folded flat. For instance, elongated strips of metal foil or plastic film might be substituted if the degradable feature of the streamer is unnecessary. Commercial tissue paper of a quality and thickness similar to facial tissue has been found to be excellent for fabrication of the streamer S. It may be any color, depending upon the requirements for visibility from the air. Woven fabrics also can be used if desired.

Figure 4:
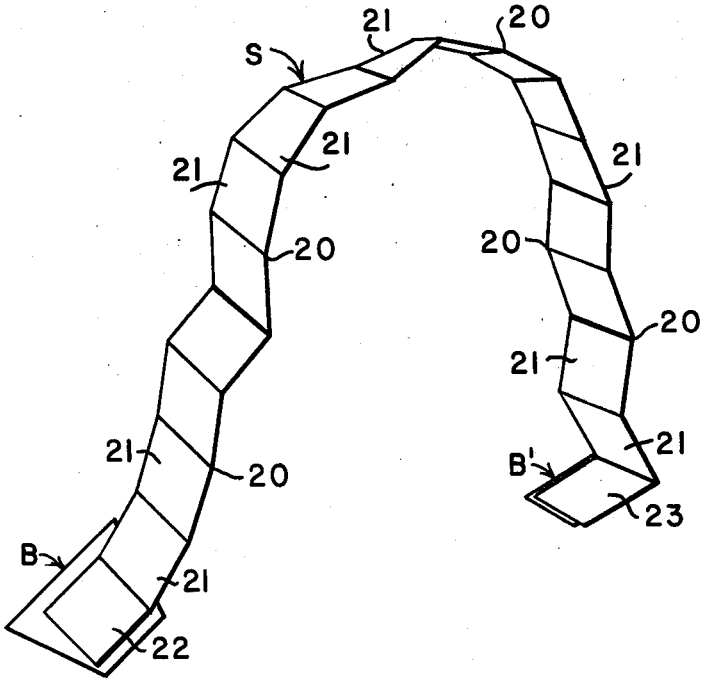
FIG. 4 is a perspective view illustrating a falling marker of this invention.

The streamer S has a plurality of transverse pleats along its length, with fold lines 20 between panels 21 of FIG. 4 producing an accordion-style between the respective first and second longitudinal end panels 22 and 23, secured to respective base members B and B′. By folding the streamer S back and forth along line 20, the drop marker can be folded to a condition in which it is relatively flat for storage and ejection purposes, with the streamer S located between the parallel base members B and B′, as in FIGS. 1–3. This forms a sandwich, the more durable base members physically overlying and protecting the weaker material comprising the streamer. The two end panels 22 and 23 of the streamer, as indicated, are respectively affixed to opposed planar surfaces of the base members B and B′, as by glue or other appropriate adhesive. Although the end panels of the streamer can be affixed to the respective base members by stapling or by use of other fasteners, biodegradable glue or other adhesive, provides a product which eliminates the problem of pollution by use of the drop marker.

As will be evident, the base member B has boundaries which extend beyond the folded boundaries of streamer S when the streamer is in its folded condition. This protects the streamer from external damage prior to use and facilitates ejection of the drop marker. The more rigid base member B can be ejected by a mechanism capable of discharging the base member, with the streamer S and base member B' following it spread between them.

The second base member B' is illustrated as being smaller in height and width than the corresponding dimensions of base member B, with the upper edge 14 of base member B' in substantial alignment with upper edge 10 of base member B. As shown, base member B' has approximately the same size as panels 21 of streamer S, which is mounted in an essentially central position of base member B. However, the preferred position of base member B' positions its top edge 14 above the top of the folded streamer, but with a corresponding bottom portion of the streamer exposed below base member B'. This positioning has been found to produce advantages in ejection, as described below. The weight per unit area of base members B and B' each exceed the weight per unit area of streamer S, although the total weight of streamer S, depending on its length, may exceed or approximate the total weight of base member B or be intermediate the total weight of base members B and B'. Normally, the combined weight of base members B and B' will exceed the total weight of streamer S. Base members B and B' may be made of similar material of the same thickness so that with the approximate ratio between areas shown, the desired weight of base member B' of one-half or more of the total weight of base member B is attained. The latter ratio is desirable to attain when the base members B and B' are made of different materials, or of similar material but different thickness.

The base members B and B' are also preferably stiffer than streamer S, as well as having a greater weight per unit area, so that they tend to fall through the air more quickly than the elongated lightweight streamer material, which tends to "float". However, the total area of the streamer is substantially greater than the total area of the base members B and B' combined. In a typical configuration, base member B has a height of five inches and a top width of six inches, while the streamer S is four inches wide and about 15 feet long and folded to a four inch square configuration with base member B' having corresponding dimensions. Of course, the streamer can be any desired length, depending upon the application of the marker to a specific crop. For instance, streamers used for marking orchards and trees should be substantially longer than those used for marking low growing crops. In any event, the drop marker tends to fall in the configuration shown in FIG. 4, with the streamer S presenting an inverted U-shaped or arched configuration having base members B and B' hanging at the respective ends of the streamer. In this way, the arched streamer S will tend to remain substantially aligned with the path of the airplane or vehicle from which it has been ejected, and will drape over the crop foliage, regardless of the crop height.

Figure 6:
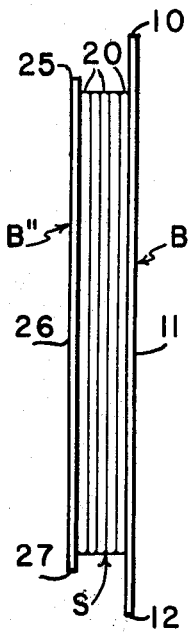
FIG. 6 is a side elevation of the marker of FIG. 5.

The alternative marker of FIGS. 5 and 6 is similar to the marker of FIG. 1, having a similar first base member B and streamer S, attached centrally to the base member B, as before. However, the second base member B'' is trapezoidal, having a longer upper edge 25, inclined side edges 26 and a shorter, lower edge 27. The base member B'' is also approximately centered with respect to base member B and thus overhangs streamer S at all edges, while the end panels of streamer S are attached, as by a biodegradable adhesive, to the respective base members B and B'', as before. Sides 26 of base member B'' are spaced inwardly from the corresponding side edges 11 of base member B, to provide clearance for ejection purposes, as described below.

Figure 7:
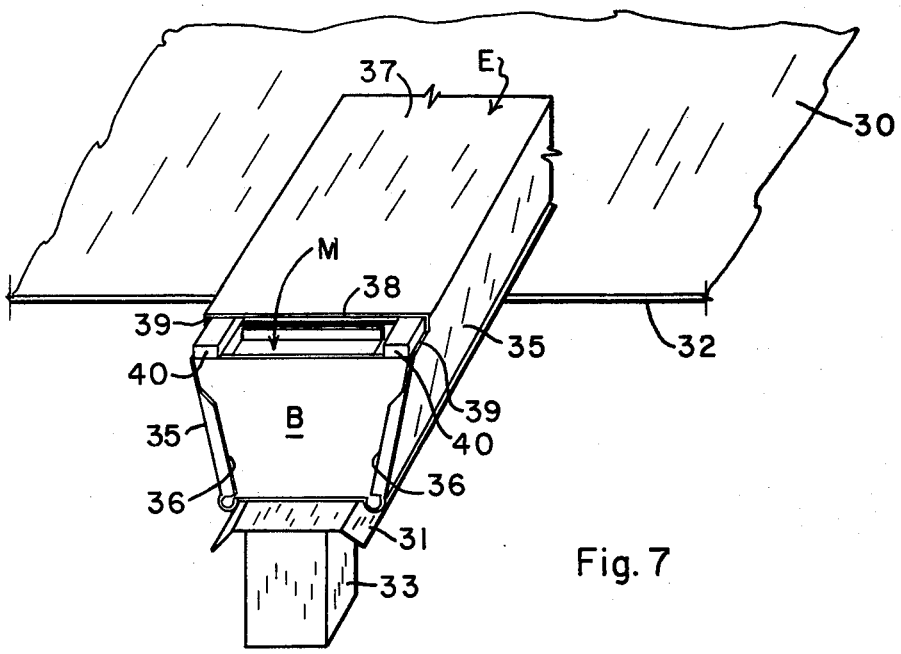
FIG. 7 is a fragmentary perspective view showing a conventional marker dispenser but illustrating the manner in which markers of this invention are stored in and ejected therefrom.

The ejector E of FIG. 7 corresponds to a commercial device of the type shown in said U.S. Pat. No. 3,470,846, shown as mounted on a wing 30 of an aircraft, as by conventional brackets attached to the wing (not shown) and connected to a mounting bracket 31 which overhangs the trailing edge 32 of the wing. The ejector includes a box-shaped container for receiving a series of markers M in the same position as illustrated in FIG. 2, i.e. with the base member B facing to the rear, and an ejection solenoid mounted in a solenoid housing 33 at the underside of the trailing end of the ejector, for moving the rearmost marker M upwardly for ejection. This solenoid is operated by a switch controlled by the pilot, who selects the position at which each of a series of markers, in turn, is to be ejected. The container has inwardly sloped side walls 35 corresponding in slope to sides 11 of base member B and each provided at its rear edge with a transverse lip or flange 36 which restrains the rearmost marker M until ejection. Neither lip 36 need extend for the complete height of the corresponding sidewall, but for only a portion, such as the lower half. The container has a top 37 integral with or attached across the sidewalls 35 and extending to a trailing edge 38 at an offset 39 in each sidewall, which accommodates a pair of flexible tabs 40, as of rubber, which extend from beneath top 37 at opposite sides. Tabs 40 exert downward pressure on base member B to prevent the trailing marker from jiggling out of the ejector when the aircraft is moving over rough ground while taxiing, or during takeoff or landing. However, the force produced by tabs 40 is insufficient to interfere with ejection of the marker by the solenoid.

A portion of bracket 31 may be the bottom for the container, or a separate bottom plate may be provided, to form an enclosure which receives, for rearward sliding movement therein, a series of markers M, which may be pressed rearwardly by air pressure exerted through the open leading end of ejector E, not shown because it is conventional. Edge 38 is so located that the top of the rearmost marker will be exposed and may be ejected upwardly by upward movement imparted by the solenoid, which may be adapted to engage the underside of base member B only. As base member B is moved upwardly, folded streamer S and base member B' will tend to move with it, although as soon as base member B has moved upwardly a distance sufficient for sides 11 to clear flanges 36, the relative air velocity will start to move base member B rearwardly of the aircraft. This will permit streamer S and base member B' to be moved with it, so that the clearance on the underside of base member B', as in FIGS. 1 and 2, will obviate any tendency for a lower corner of base member B' to hit or catch against one of the flanges 36.

Although more than one embodiment of this invention has been illustrated and described, it will be understood that other embodiments may exist and that various changes may be made, all without departing from the spirit and scope of this invention.

What is claimed is:

1. A drop marker, comprising:

a first base member;

a second base member;

an elongated streamer having transverse pleats folded accordion-style between the longitudinal ends thereof;

one longitudinal end of said streamer being fixed to said first base member;

the opposite longitudinal end of said streamer being fixed to said second base member;

the total area of said streamer being substantially greater than the total area of said first and second base members combined;

the weight per unit area of each of said first and second base members being greater than the weight per unit area of said streamer; and said streamer being foldable to a first condition in which it is stored flat between said base members with the base members substantially parallel to one another for reception in an ejection device for ejecting said marker from an aircraft into the air, with unfolding to a second condition in which the streamer is extended longitudinally with the base members at the respective ends thereof disposed at positions below the portion of the streamer to which attached.

2. A drop marker as set forth in claim 1, wherein:

said first base member has edges which extend beyond the folded boundaries of said streamer when in said first condition.

3. A drop marker as set forth in claim 1, wherein:

said first base member has side edges which extend beyond the side edges of said second base member when said streamer is in said first condition.

4. A drop marker as set forth in claim 3, wherein:

said first base member is trapezoidal in shape with inclined side edges.

5. A drop marker as set forth in claim 4, wherein:

said second base member is rectangular in shape.

6. A drop marker as set forth in claim 4, wherein:

said second base member is trapezoidal in shape corresponding to said first base member.

7. A drop marker as set forth in claim 3, wherein:

said second base member is smaller in size than said first base member and its weight exceeds one half the weight of said first base member.

8. A drop marker as set forth in claim 7, wherein:

the weight per unit area of said second base member is different than the weight per unit area of said first base member.

9. A drop marker as set forth in claim 1, wherein:

said first base member is formed of relatively stiff sheet material;

said second base member is formed of relatively stiff sheet material; and said streamer is formed of flexible material.

10. A drop marker as set forth in claim 9, wherein:

said first and second base members are formed of cardboard; and said streamer is formed of tissue paper.

* * * * *